US011522293B2

(12) United States Patent
Mori

(10) Patent No.: US 11,522,293 B2
(45) Date of Patent: Dec. 6, 2022

(54) ANTENNA AND ELECTRONIC DEVICE

(71) Applicant: SONY CORPORATION, Tokyo (JP)

(72) Inventor: Nobuyuki Mori, Tokyo (JP)

(73) Assignee: SONY CORPORATION, Tokyo (JP)

( * ) Notice: Subject to any disclaimer, the term of this patent is extended or adjusted under 35 U.S.C. 154(b) by 20 days.

(21) Appl. No.: 17/250,519

(22) PCT Filed: May 27, 2019

(86) PCT No.: PCT/JP2019/020907
§ 371 (c)(1),
(2) Date: Jan. 31, 2021

(87) PCT Pub. No.: WO2020/031466
PCT Pub. Date: Feb. 13, 2020

(65) Prior Publication Data

US 2021/0313698 A1 Oct. 7, 2021

(30) Foreign Application Priority Data

Aug. 7, 2018 (JP) ..... JP2018-148585

(51) Int. Cl.
*H01Q 9/28* (2006.01)
*H01Q 5/364* (2015.01)
*H01Q 5/385* (2015.01)

(52) U.S. Cl.
CPC ..... *H01Q 9/285* (2013.01); *H01Q 5/364* (2015.01); *H01Q 5/385* (2015.01)

(58) Field of Classification Search
CPC ..... H01Q 5/30; H01Q 5/364; H01Q 5/307; H01Q 5/357; H01Q 5/378; H01Q 5/385; H01Q 5/392; H01Q 5/48; H01Q 5/49; H01Q 9/16; H01Q 9/28; H01Q 9/285; H01Q 21/30
See application file for complete search history.

(56) References Cited

U.S. PATENT DOCUMENTS

2011/0316734 A1 12/2011 Svensson
2016/0336657 A1* 11/2016 Wunsch ..... H01Q 9/28

FOREIGN PATENT DOCUMENTS

| | | | |
|---|---|---|---|
| CN | 102257675 | A | 11/2011 |
| JP | 2003-078345 | A | 3/2003 |
| JP | 2016-146558 | A | 8/2016 |
| WO | 2010/074618 | A1 | 7/2010 |

OTHER PUBLICATIONS

International Search Report and Written Opinion of PCT Application No. PCT/JP2019/020907, dated Aug. 6, 2019, 06 pages of ISRWO.

* cited by examiner

*Primary Examiner* — Robert Karacsony
(74) *Attorney, Agent, or Firm* — Chip Law Group

(57) ABSTRACT

An antenna is provided with a dielectric layer, a metal layer provided on one surface of the dielectric layer, a radiation element provided on the other surface of the dielectric layer, the radiation element including a slit portion in a central portion, a radiation system of which is magnetic field current radiation by electric field induction, a contactless feed element arranged above the slit portion, and a parasitic radiation element, a radiation system of which is electric field current radiation by magnetic field induction.

9 Claims, 7 Drawing Sheets

ANTENNA AND ELECTRONIC DEVICE

CROSS REFERENCE TO RELATED APPLICATIONS

This application is a U.S. National Phase of International Patent Application No. PCT/JP2019/020907 filed on May 27, 2019, which claims priority benefit of Japanese Patent Application No. JP 2018-148585 filed in the Japan Patent Office on Aug. 7, 2018. Each of the above-referenced applications is hereby incorporated herein by reference in its entirety.

TECHNICAL FIELD

The present technology relates to, for example, an antenna applicable to a transmission or reception antenna of a wireless local area network (LAN) and an electronic device provided with the antenna.

BACKGROUND ART

An antenna disclosed in Patent Document 1 has been proposed for the purpose of providing a small and thin antenna and a small communication device using this antenna. This antenna is provided with a dielectric layer, a metal layer provided on one surface of the dielectric layer, and a radiation element layer provided on the other surface thereof. Furthermore, the radiation element layer includes a slit portion in the central portion thereof and a contactless feed element above the slit portion.

Furthermore, Patent Document 2 discloses a configuration in which a parasitic element coupled to a slot-type bowtie antenna as a base by a magnetic flow is utilized. That is, a configuration is disclosed in which the slot-type bowtie antenna is formed, and the parasitic element having a strip shape or similar shape galvanically isolated from a metal plate and coupled to the same in a high-frequency manner by a magnetic flow is arranged substantially parallel to a Y-axis.

CITATION LIST

Patent Document

Patent Document 1: Japanese Patent Application Laid-Open No. 2016-146558

Patent Document 2: Japanese Patent Application Laid-Open No. 2003-078345

SUMMARY OF THE INVENTION

Problems to be Solved by the Invention

The antenna disclosed in Patent Document 1 may be made thinner and smaller, and has an excellent effect that this may be used both in a free space and on a conductor, and may be attached around metal parts of home appliances, automobiles and the like. As an application of the antenna, in a case of assuming an antenna for a wireless LAN, this desirably supports two bands: a 2.4 GHz band and a 5 GHz band. In Patent Document 1, the radiation frequency of the antenna is determined by the shape and length of the radiation element 13. Regarding this radiation frequency, it is proposed to expand the resonance frequency by making a rectangular shape a polygonal shape as illustrated as the radiation element layer 113 in FIG. 7, the radiation element layer 213 in FIG. 8, and the radiation element layer 413 in FIG. 12 of Patent Document 1. However, regarding multi-resonance due to deformation of the radiation element layer, there is a problem that, in a case where two or more frequencies are wanted to be realized simultaneously in adjustment to allow a resonance frequency to resonate at a desired frequency, adjustment of one frequency affects the resonance of the other frequency. Furthermore, there is a problem that it is difficult to obtain a desired band. Moreover, since the shape of the radiation element is made the polygonal shape in order to promote multi-resonance, there is a problem that a radiation area is reduced and radiation intensity is deteriorated.

The antenna disclosed in Patent Document 2 is provided with the parasitic element coupled by the magnetic field, but there has been a problem that the position specification of the parasitic element relative to the slot-type bowtie antenna is strict and the specification of the positional relationship between the parasitic element and the feed element is strict.

Therefore, an object of the present technology is to provide an antenna supporting wider frequencies and wider band and an electronic device provided with the antenna.

Solutions to Problems

The present technology is an antenna including a dielectric layer, a metal layer provided on one surface of the dielectric layer, a radiation element layer provided on the other surface of the dielectric layer, the radiation element layer including a slit portion in a central portion, a radiation system of which is magnetic field current radiation by electric field induction, a contactless feed element arranged above the slit portion, and a parasitic radiation element, a radiation system of which is electric field current radiation by magnetic field induction. Furthermore, the present technology is an electronic device provided with such antenna.

Effects of the Invention

According to at least one embodiment, the present technology may provide an antenna supporting wider frequencies and a wider band. Note that, the effects herein described are not necessarily limited and may be any of the effects described in the present technology or other effects.

MODE FOR CARRYING OUT THE INVENTION

An embodiment and the like of the present technology are hereinafter described with reference to the drawings. Note that the embodiment and the like hereinafter described are preferred specific examples of the present technology, and the contents of the present technology are not limited to the embodiment and the like.

Figure 1:
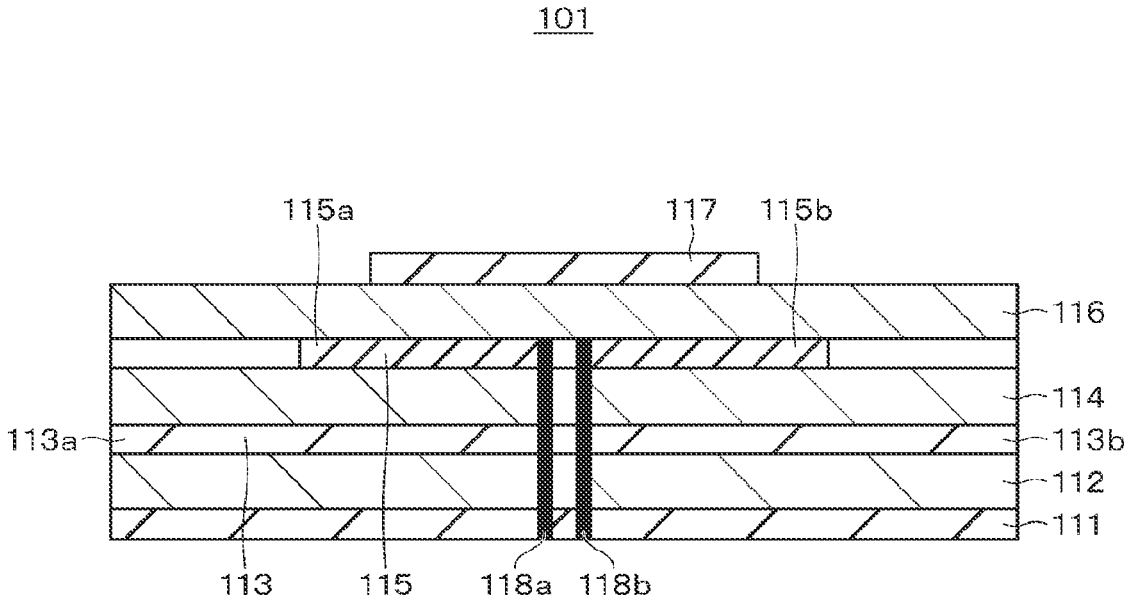
FIG. 1 is a cross-sectional view of one embodiment of an antenna according to the present technology.
Figure 2:
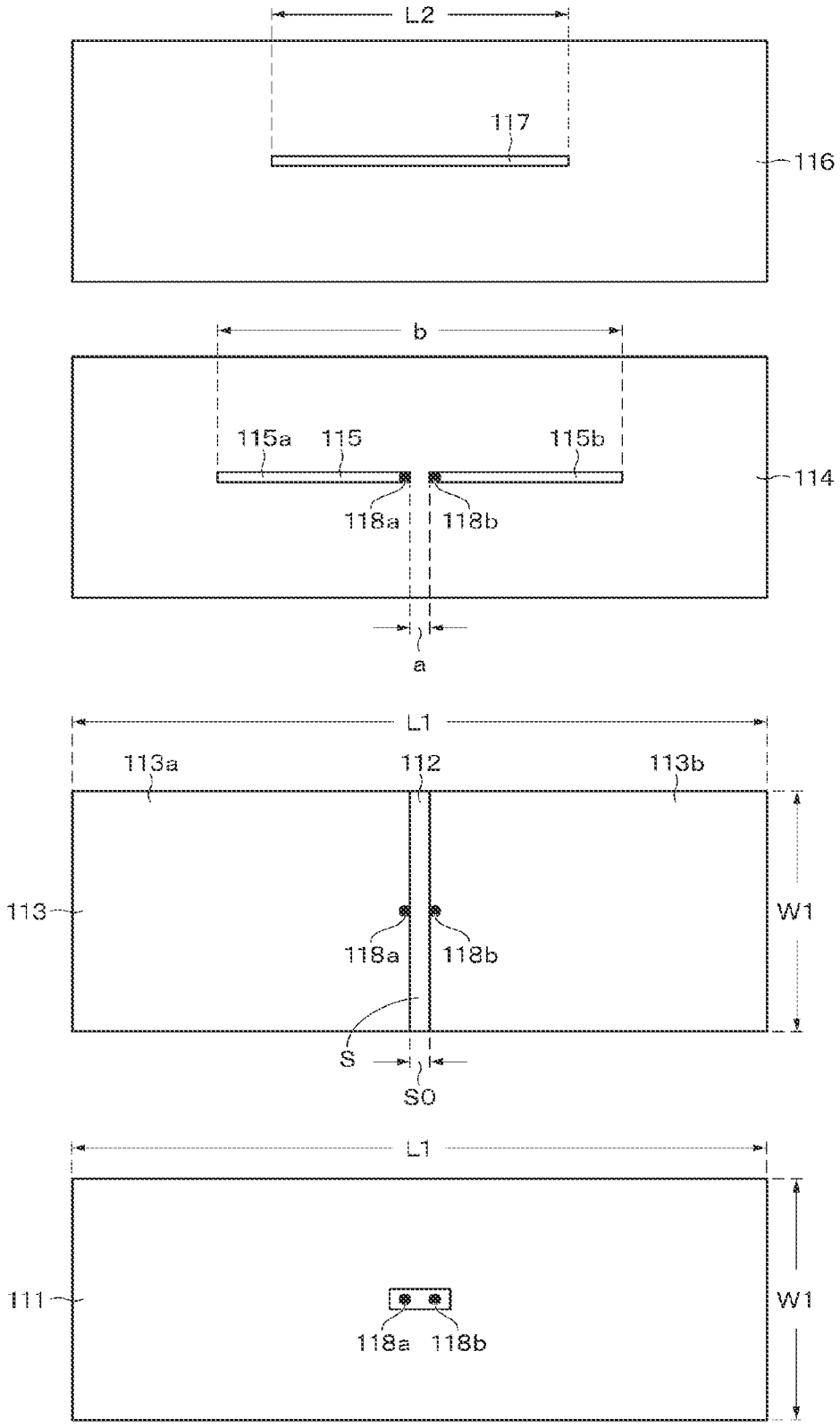
FIG. 2 is an exploded plan view of FIG. 1.

One embodiment of the present technology is described with reference to FIGS. 1 and 2. FIG. 1 is a cross-sectional view of an antenna 101, and FIG. 2 is a plan view of each unit of the antenna 101. The antenna 101 has a stacked structure, and a metal layer 111 such as copper is arranged on a bottom surface of a dielectric layer 112. The metal layer 111 and the dielectric layer 112 have the same shape. Here, the metal layer 111 has a width W1 and a length L1. The dielectric layer 112 has a thickness t1 and a relative permittivity c1.

A radiation element (plate-shaped dipole antenna) 113 is arranged on an upper surface of the dielectric layer 112. The radiation element 113 includes radiation element units 113*a* and 113*b*. The radiation element 113 includes a slit portion S having a width S0 in the central portion of metal having the same size as the metal layer 111.

Moreover, a dielectric layer 114 is arranged on an upper surface of the radiation element 113, and a contactless feed element 115 (dipole antenna) is arranged on an upper surface of the dielectric layer 114. The contactless feed element 115 includes contactless feed element units 115*a* and 115*b*. The dielectric 114 has the same size as the metal layer 111, and has a thickness t2 and a relative permittivity E2. The contactless feed element 115 is the dipole antenna having a length b and a gap a arranged orthogonally to the slit portion S.

A dielectric layer 116 as an isolation layer is arranged on an upper surface of the contactless feed element 115, and a parasitic radiation element 117 is arranged on the dielectric layer 116. The dielectric 116 has the same size as the metal layer 111, and has a thickness t3 and a relative permittivity E3. The parasitic radiation element 117 is an antenna having a length L2. A wireless module may be arranged on the dielectric layer 116. Note that, although the metal layer 111, the dielectric layer 112, the dielectric layer 114, and the dielectric layer 116 have the same shape, they do not necessarily have the same shape. Furthermore, the dielectric layer may be an air layer.

Power is fed from an exposed surface of the metal layer 111 via through holes 118*a* and 118*b* connected to the contactless feed element units 115*a* and 115*b*, respectively. That is, power is fed to the antenna between tip ends of the through holes 118*a* and 118*b*. The exposed surface of the metal layer 111 is a surface located on a side opposite to a radiation direction of the antenna.

The antenna according to one embodiment of the present technology described above has substantially similar performances in a case where this is arranged in a free space and in a case where this is arranged on a conductor plate. Therefore, this may be attached to electronic devices such as a communication device, a television, an audio playback device, a game device, and a mobile device, and around metal parts of an automobile and the like.

Figure 3:
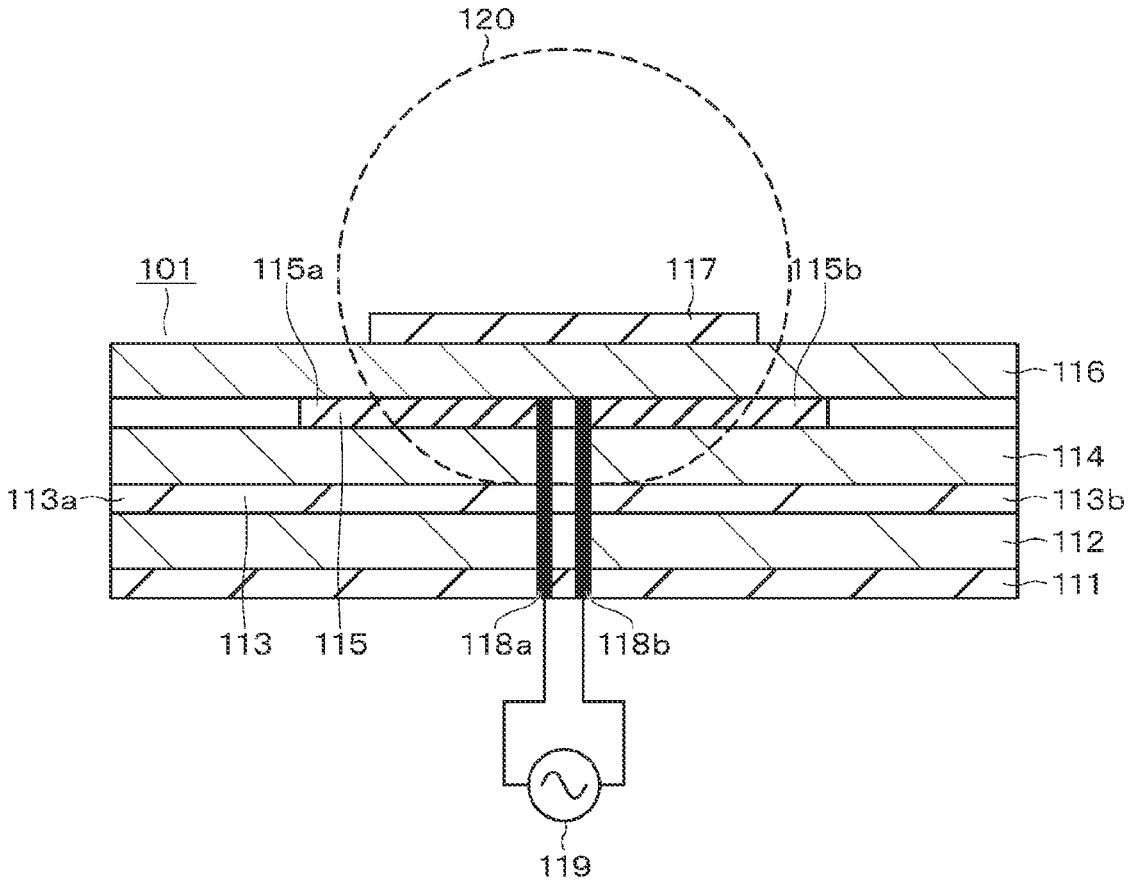
FIG. 3 is a cross-sectional view illustrating a radiation operation according to one embodiment of the present technology.

The operation and action of one embodiment of the present technology are described with reference to FIGS. 3 and 4. In a case illustrated in FIG. 3, by feeding a frequency A [Hz] to a feed unit 119, a signal is fed to the contactless feed element units 115*a* and 115*b* via the through holes 118*a* and 118*b*, respectively. At that time, the length L1 including the radiation element units 113*a* and 113*b* and the slit portion S therebetween is a length half the wavelength of the frequency A [Hz], and an electric field is generated between slits. A magnetic field current is generated in the radiation element units 113*a* and 113*b* by this electric field, and a radio wave is radiated from the radiation element units 113*a* and 113*b* as an antenna radiation pattern 120 of the frequency A [Hz]. An example of the frequency A [Hz] is a 2.4 GHz band of a wireless LAN.

Figure 4:
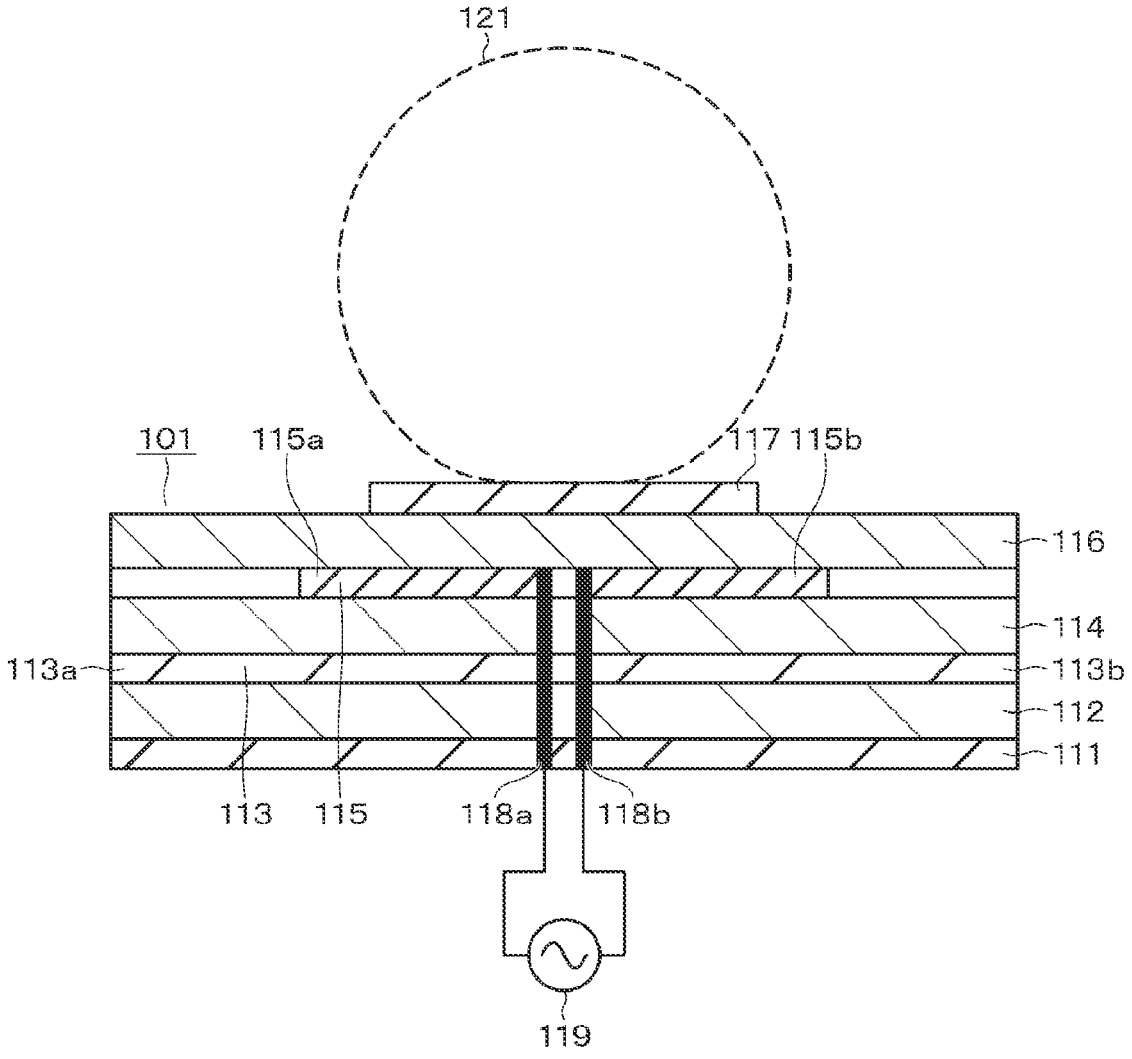
FIG. 4 is a cross-sectional view illustrating a radiation operation according to one embodiment of the present technology.

In FIG. 4, by feeding a frequency B [Hz] to the feed unit 119, a signal is fed to the contactless feed element units 115*a* and 115*b* via the through holes 118*a* and 118*b*, respectively. At that time, the length L2 of the parasitic radiation element 117 is a length half the wavelength of the frequency B [Hz], and a magnetic field is generated in the parasitic radiation element 117. An electric field current is generated in the parasitic radiation element 117 by this magnetic field, and a radio wave is radiated as an antenna radiation pattern 121 of the frequency B [Hz]. An example of the frequency B [Hz] is a 5 GHz band of a wireless LAN. The frequencies A [Hz] and B [Hz] may be switched by a wireless communication device.

In one embodiment of the present technology, a new radiation element may be provided by newly adding the parasitic radiation element 117 without reducing the radiation element bodies in the configuration of Patent Document 1. Moreover, electromagnetic field induction is performed by different radiation systems; a radiation system of the radiation element 113 is magnetic field current radiation by electric field induction, and a radiation system of the parasitic radiation element 117 is electric field current radiation by magnetic field induction. Furthermore, the radiation element 113 and the parasitic radiation element 117 are provided on different surfaces of the dielectric layer 116. As a result, there is an advantage that even in a case where one of the lengths L1 and L2 that determine resonance frequencies is changed, the resonance frequency of the other is not easily affected. Therefore, it becomes easy to adjust a value of the frequency by each radiation element.

Figure 5:
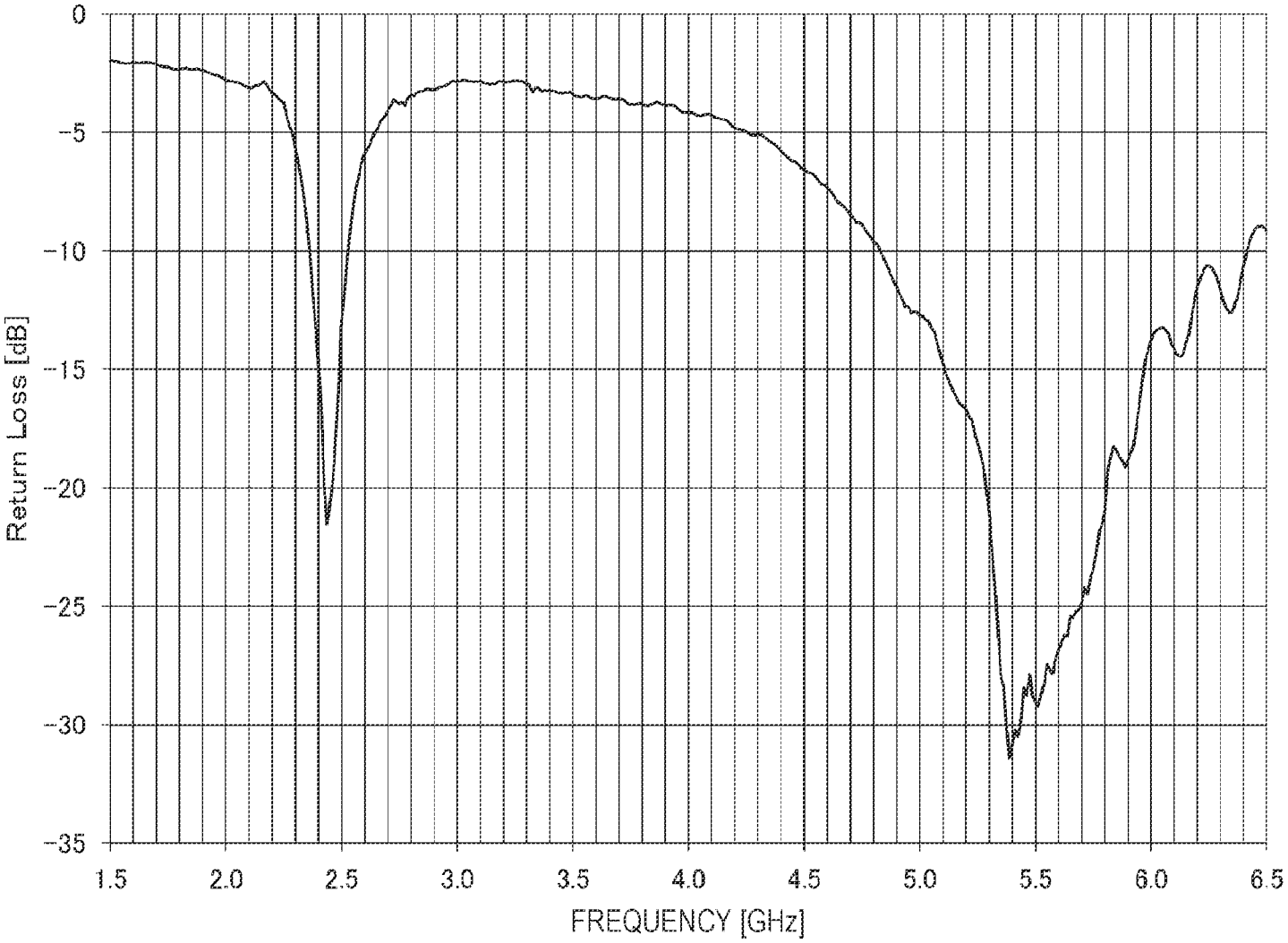
FIG. 5 is a graph illustrating a frequency characteristic of one embodiment of the present technology.

FIG. 5 illustrates a characteristic example of one embodiment of the present technology. A return loss [dB] is plotted along the ordinate. The return loss is the smallest between 2.4 GHz and 2.5 GHz and at 5.4 GHz, and an antenna capable of supporting two bands is realized.

Figure 6:
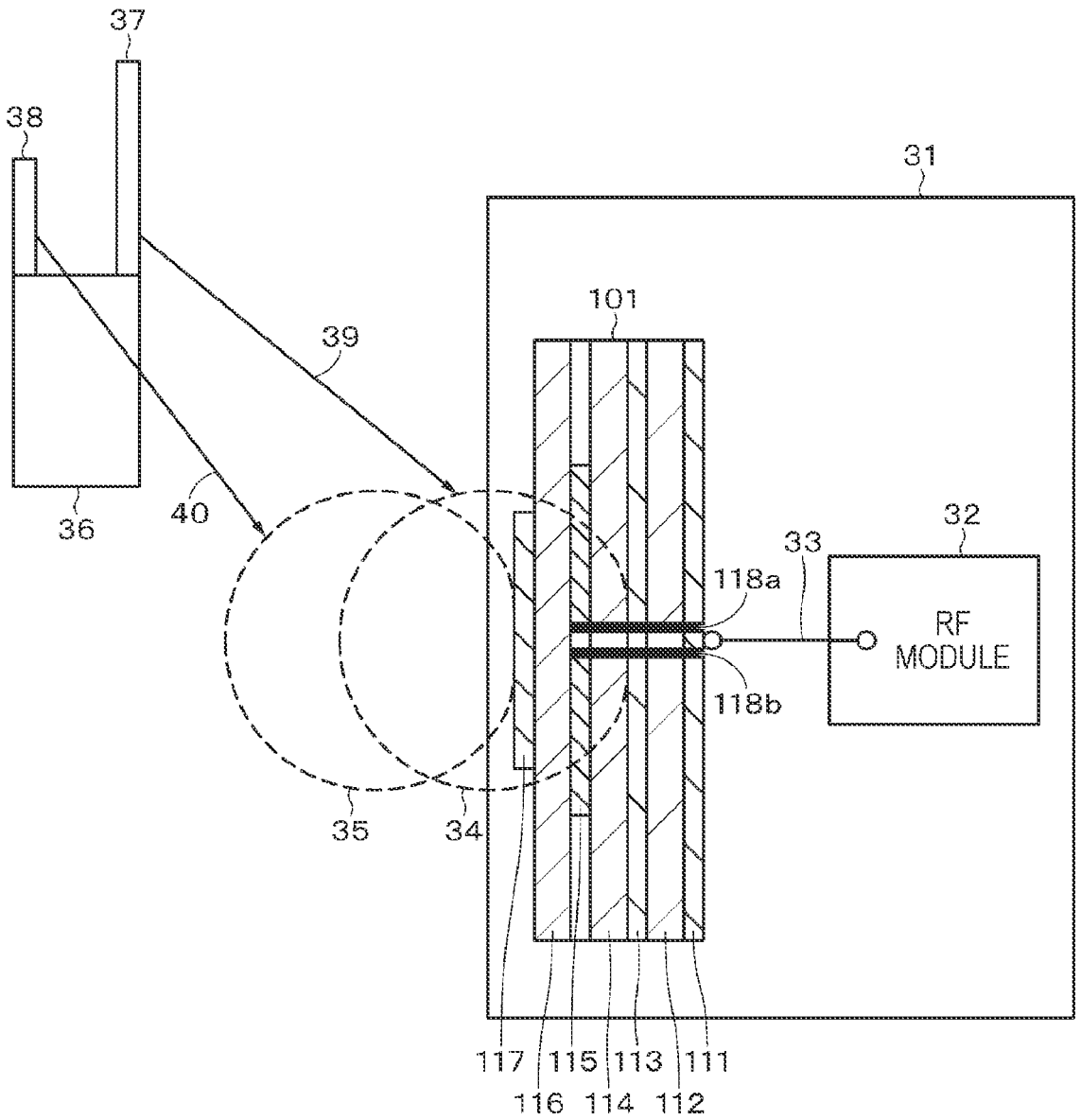
FIG. 6 is a block diagram illustrating a configuration of a communication device using an antenna according to one embodiment of the present technology.

FIG. 6 illustrates a configuration example in a case where the antenna 101 according to one embodiment of the present technology is used in a communication device. In FIG. 6, in a case where a common wireless device 36 and a wireless device 31 equipped with the antenna 101 of the present technology described above perform wireless communication, an air propagation radio wave 39 radiated from an antenna 37 supporting one frequency of the wireless device 36 is received by an antenna radiation pattern 34 (for example, the radiation pattern 120 illustrated in FIG. 3) supporting the same frequency and is received by an RF module 32 via an RF transmission line 33. Furthermore, similarly, an RF signal transmitted from the RF module 32 is radiated from the antenna radiation pattern 34 via the RF transmission line 33 to become the air propagation radio wave 39 and is received by the antenna 37 being the antenna of the frequency supported by the common wireless device 36.

In a case where the common wireless device 36 transmits at another frequency, an air propagation radio wave 40 radiated from an antenna 38 supporting the same is received by an antenna radiation pattern 35 (for example, the radiation pattern 121 illustrated in FIG. 3) supporting the same frequency and is received by the RF module 32 via the RF transmission line 33. Furthermore, similarly, the RF signal transmitted from the RF module 32 is radiated from the antenna radiation pattern 35 via the RF transmission line 33 to become the air propagation radio wave 40 and is received by the antenna 38 being the antenna of the frequency supported by the common wireless device 36.

Figure 7:
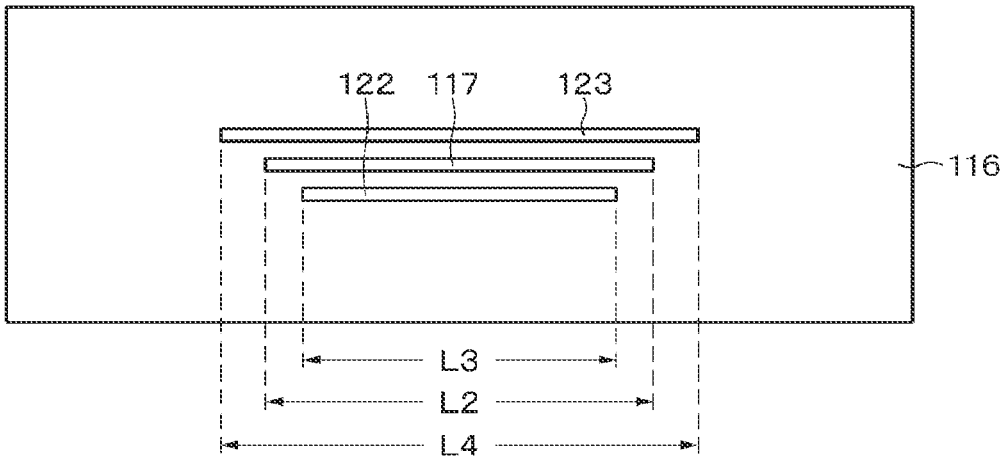
FIG. 7 is a plan view illustrating a variation.

A variation of one embodiment of the present technology is described with reference to FIG. 7. This is a configuration in which parasitic radiation elements 122 and 123 parallel to the parasitic radiation element 117 having different lengths are added around the above-described parasitic radiation element 117. A length of the parasitic radiation element 122 is set to L3, and a length of the parasitic radiation element 123 is set to L4. With this configuration, in a case where the contactless feed element 115 feeds a frequency C [Hz] half the wavelength of which corresponds to L3, the parasitic radiation element 122 radiates a radio wave of the frequency C [Hz]. Furthermore, in a case where the contactless feed element 115 feeds a frequency D [Hz] half the wavelength of which corresponds to L4, the parasitic radiation element 123 radiates a radio wave of the frequency D [Hz]. By adding the parasitic elements in this manner, the number of resonating resonance frequencies may be increased, and a multiple-frequency compatible antenna and a wideband frequency compatible antenna may be realized.

Figure 8:
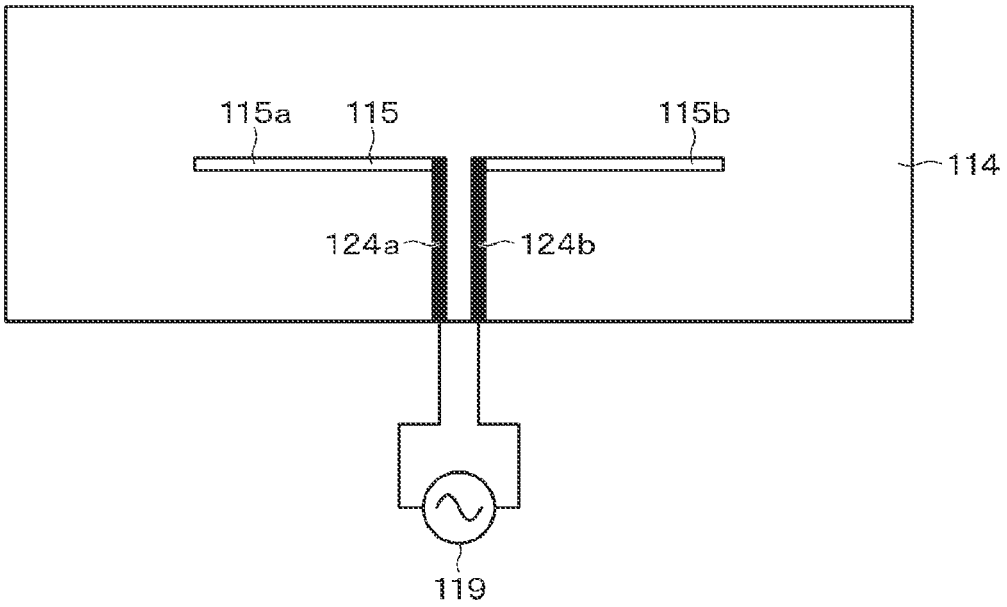
FIG. 8 is a plan view illustrating another variation.

FIG. 8 illustrates another variation of the present technology. In one embodiment, the through holes 118*a* and 118*b* are added to the contactless feed element 115 to feed power from the side opposite to the radiation direction. However, by adding feed patterns 124*a* and 124*b* to the dielectric layer 114 on which the parasitic radiation element 115 is arranged, it is possible to feed power from not a back surface but a side surface. Since it is possible to feed power from the back surface or the side surface in the radiation direction of the antenna as in the present technology, an appearance of the wireless device may be easily designed.

Although one embodiment of the present technology is heretofore described specifically, the present technology is not limited to the above-described one embodiment, and various modifications based on the technical idea of the present technology may be made. Furthermore, the configuration, method, step, shape, material, numerical value and the like described in the above-described embodiment are illustrative only, and the configuration, method, step, shape, material, numerical value and the like different from those may also be used as necessary.

Note that, the present technology may also have the following configuration.

(1)

An antenna including:

a dielectric layer;

a metal layer provided on one surface of the dielectric layer;

a radiation element provided on the other surface of the dielectric layer, the radiation element including a slit portion in a central portion, a radiation system of which is magnetic field current radiation by electric field induction;

a contactless feed element arranged above the slit portion; and a parasitic radiation element, a radiation system of which is electric field current radiation by magnetic field induction.

(2)

The antenna according to (1), in which the parasitic radiation element is arranged above the contactless feed element across a dielectric layer.

(3)

The antenna according to (1) or (2), in which one or a plurality of parasitic radiation elements having different lengths is arranged around the parasitic radiation element.

(4)

The antenna according to any one of (1) to (3), in which a feed point is provided on an exposed surface of the metal layer for the contactless feed element.

(5)

The antenna according to any one of (1) to (4), in which a feed point is provided on a side surface of the contactless feed element.

(6)

An electronic device including: the antenna according to (1).

(7)

The electronic device according to (6), in which, in the antenna, the parasitic radiation element is arranged above the contactless feed element across a dielectric layer.

(8)

The electronic device according to (6) or (7), in which, in the antenna, one or a plurality of parasitic radiation elements having different lengths is arranged around the parasitic radiation element.

(9)

The electronic device according to any one of (6) to (8), in which, in the antenna, a feed point is provided on an exposed surface of the metal layer for the contactless feed element.

(10)

The electronic device according to any one of (6) to (9), in which, in the antenna, a feed point is provided on a side surface of the contactless feed element.

REFERENCE SIGNS LIST

101 Antenna
111 Metal layer
112, 114, 116 Dielectric layer
113 Radiation element
113*a*, 113*b* Radiation element unit
115 Contactless feed element
115*a*, 115*b* Contactless feed element unit
117, 122, 123 Parasitic radiation element
118*a*, 118*b* Through hole
119 Feed point

The invention claimed is:

1. An antenna, comprising:

a dielectric layer;

a metal layer on a first surface of the dielectric layer;

a radiation element on a second surface of the dielectric layer, wherein the radiation element includes a slit portion in a central portion of the radiation element, and a radiation system of which the radiation element is magnetic field current radiation by electric field induction;

a contactless feed element above the slit portion; and a first parasitic radiation element, wherein a radiation system of the first parasitic radiation element is electric field current radiation by magnetic field induction, at least one second parasitic radiation element is around the first parasitic radiation element, and each of the at least one second parasitic radiation element has a different length.

2. The antenna according to claim 1, wherein the first parasitic radiation element is above the contactless feed element across a dielectric layer.

3. The antenna according to claim 1, wherein a feed point is on an exposed surface of the metal layer for the contactless feed element.

4. The antenna according to claim 1, wherein a feed point is on a side surface of the contactless feed element.

5. An electronic device, comprising:

an antenna that comprises:

a dielectric layer;

a metal layer on a first surface of the dielectric layer;

a radiation element on a second surface of the dielectric layer, wherein the radiation element includes a slit portion in a central portion of the radiation element, and a radiation system of the radiation element is magnetic field current radiation by electric field induction;

a contactless feed element above the slit portion; and a first parasitic radiation element, wherein a radiation system of the first parasitic radiation element is electric field current radiation by magnetic field induction, at least one second parasitic radiation element is around the first parasitic radiation element, and each of the at least one second parasitic radiation element has a different length.

6. The electronic device according to claim 5, wherein, in the antenna, the first parasitic radiation element is above the contactless feed element across a dielectric layer.

7. The electronic device according to claim 5, wherein, in the antenna, a feed point is on an exposed surface of the metal layer for the contactless feed element.

8. The electronic device according to claim 5, wherein, in the antenna, a feed point is on a side surface of the contactless feed element.

9. An antenna, comprising:

a dielectric layer;

a metal layer on a first surface of the dielectric layer;

a radiation element on a second surface of the dielectric layer, wherein the radiation element includes a slit portion in a central portion of the radiation element, and a radiation system of the radiation element is magnetic field current radiation by electric field induction;

a contactless feed element above the slit portion, wherein a feed point is on an exposed surface of the metal layer for the contactless feed element; and a parasitic radiation element, wherein a radiation system of the parasitic radiation element is electric field current radiation by magnetic field induction.

* * * * *